US007029093B2

(12) United States Patent
Tee et al.

(10) Patent No.: US 7,029,093 B2
(45) Date of Patent: Apr. 18, 2006

(54) MODULAR SERVICE STATION ASSEMBLY

(75) Inventors: Ah Chong Tee, Singapore (SG); Bee Bee Ang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 264 days.

(21) Appl. No.: 10/741,131

(22) Filed: Dec. 19, 2003

(65) Prior Publication Data

US 2005/0134634 A1 Jun. 23, 2005

(51) Int. Cl.
*B41J 2/165* (2006.01)

(52) U.S. Cl. ..... 347/32; 347/29; 347/30; 347/33; 347/35

(58) Field of Classification Search ..... 347/22–24, 347/29, 30, 32, 33
See application file for complete search history.

(56) References Cited

U.S. PATENT DOCUMENTS 6,588,873 B1 * 7/2003 Walsh et al. ..... 347/23
6,755,504 B1 * 6/2004 Tee et al. ..... 347/33
6,918,648 B1 * 7/2005 Tee et al. ..... 347/29

* cited by examiner

*Primary Examiner*—Shih-Wen Hsieh

(57) ABSTRACT

A modular service station assembly for use with an inkjet printer having a housing with front and rear ends having a print zone and one or more carriage assemblies adapted to accommodate at least one print cartridge having a print head. The service station assembly has at least one ink spittoon. The service station also includes a wiping station having at least one wiper for cleaning the print head. The at least one ink spittoon and the wiping station are separately disposed to one side of the print zone. The service station further includes a capping station having at least one cap for sealing the print head disposed within the print zone. These discrete modules are arranged to minimize the width of the printer housing.

10 Claims, 2 Drawing Sheets

MODULAR SERVICE STATION ASSEMBLY

FIELD OF INVENTION

The present invention relates generally to inkjet printer mechanisms and more particularly to service station assemblies for use in inkjet printers.

BACKGROUND OF THE INVENTION

Various inkjet technologies are employed by printer manufacturers including thermal bubble and piezoelectric. In a thermal inkjet printer, tiny resistors create heat, and this heat vaporizes ink to create a bubble. As the bubble expands, some of the ink is expelled from the nozzles onto the print medium. By selectively energizing the resistors as the print head moves across the print medium, the ink is disposed in a pattern on the print medium to form a desired image.

Inkjet printers operate using a print head comprising a plurality of nozzles, which spray ink directly onto a print medium. Typically the print head is an integral part of the print cartridge, the print cartridge further including an ink reservoir. One or more print cartridges are mounted on a movable print carriage. The print carriage moves laterally across the print medium depositing the ink on the print medium in a pattern to form an image.

Print head nozzles often become clogged with ink or particulates resulting in inefficient operation of the print heads and reduced print quality. Therefore, inkjet printers usually include a service station that provides functions for maintenance of the print heads. The major service station functions comprise spitting, capping and wiping of the print head to keep the nozzles functioning properly.

When not in use, the print head nozzles are sealed by a capping system to prevent drying out of ink within the print head and cartridge and contamination thereof by particulates. Any clogging of the print head may be cleared by forcing ink to be discharged through each of the nozzles. Expelled ink is collected in a spitting reservoir, often referred to as a "spittoon", which is associated with the service station. Service stations typically further provide a wiper, to wipe the surface of the print head in order to remove any ink residue or contaminants such as dust or fibres that may have collected on the print head surface.

The service station is typically a stationary assembly mounted within the printer housing. The print head is brought into alignment with the service station for maintenance. In most conventional inkjet printers, the service station components are disposed in a side-by-side configuration in the region where the print carriages return when the printer is idle. This region is usually located to one side of the print zone of the printer. Therefore the width of the printer housing is typically a combined width of the print zone and the adjacent print carriage assemblies, and the width of the service station arranged end-to-end.

The width of the printer housing is an important consideration, particularly in the case of desktop printers since desk space is often limited. It would therefore be advantageous to provide a printer housing of reduced width. Reducing the overall width of the printer housing may provide additional advantages such as reduced weight and lower cost of manufacture.

SUMMARY OF THE INVENTION

Briefly, the present invention provides a modular service station assembly for use with an inkjet printer having a housing with front and rear ends having a print zone and one or more carriage assemblies adapted to accommodate at least one print cartridge having a print head. The service station assembly has at least one ink spittoon. The service station also includes a wiping station having at least one wiper for cleaning the print head. The at least one ink spittoon and the wiping station are separately disposed to one side of the print zone. The service station further includes a capping station having at least one cap for sealing the print head disposed within the print zone. These discrete modules are arranged to minimize the width of the printer housing.

BRIEF DESCRIPTION OF THE DRAWINGS

The invention will now be described in further detail by reference to the attached drawings illustrating example forms of the invention. It is to be understood that the particularity of the drawings does not supersede the generality of the preceding description of the invention. In the drawings.

DETAILED DESCRIPTION OF THE DRAWINGS

Figure 1:
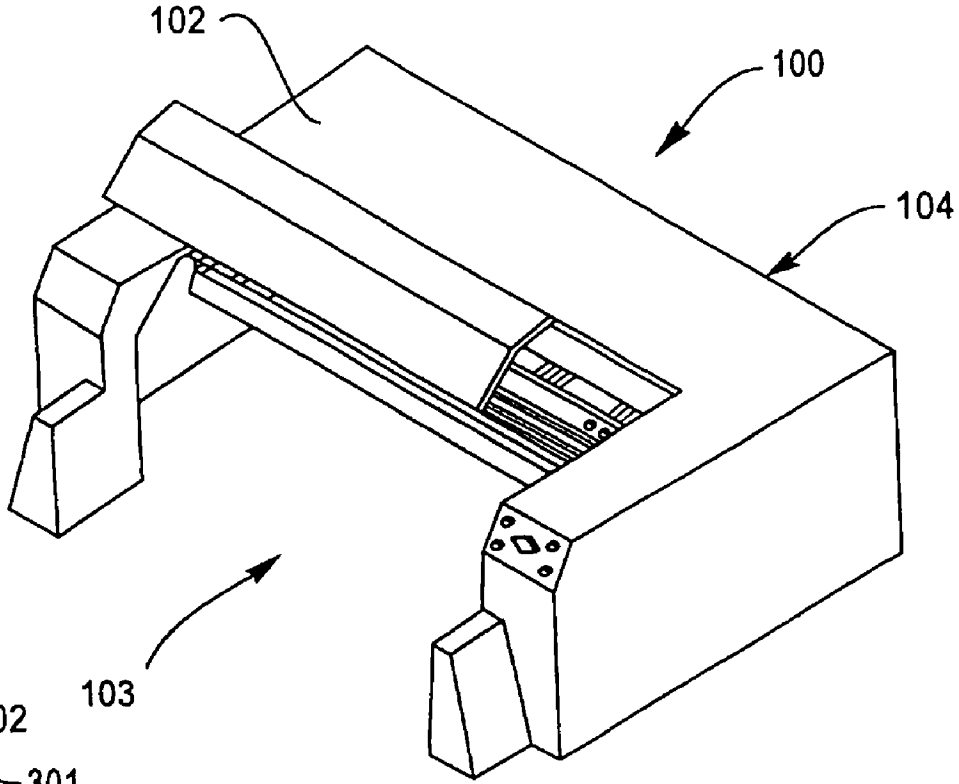
FIG. 1 illustrates a perspective view of an inkjet printer in accordance with an embodiment of the present invention.

FIG. 1 shows a perspective view of the form of an inkjet printer 100 in accordance with an embodiment. The modular service station assembly of the present invention is adapted for use in an inkjet printer 100, the inkjet printer including a housing 102 with front 103 and rear 104 ends.

Figure 2:
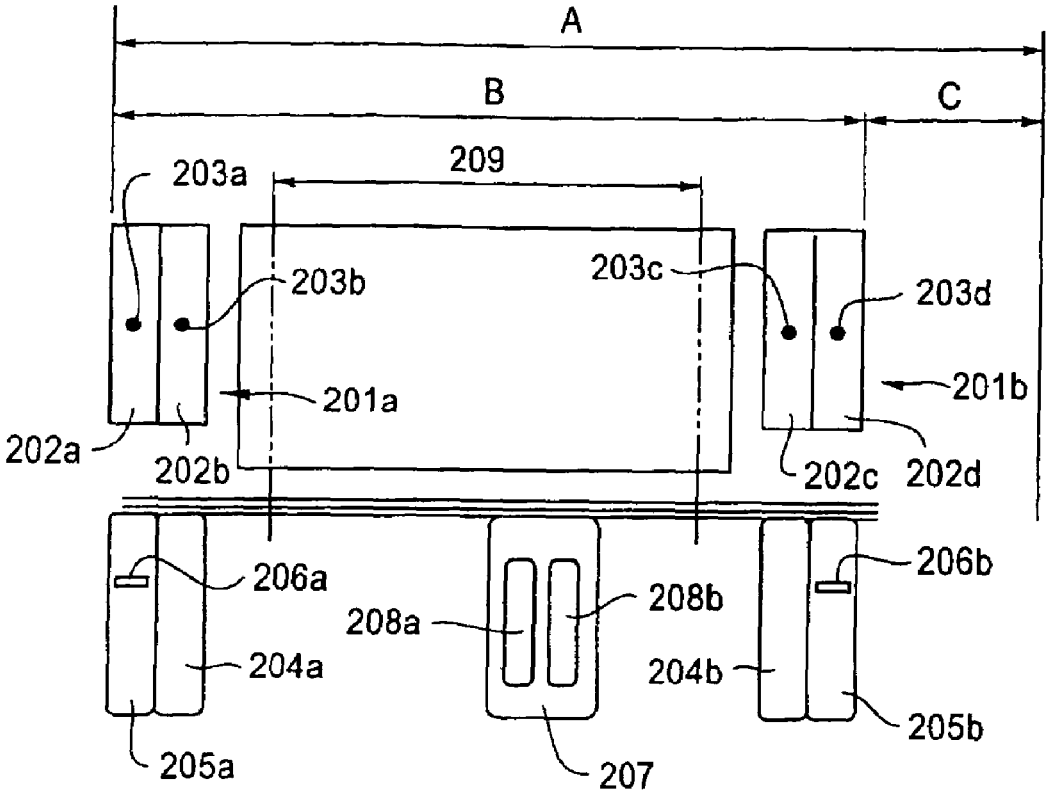
FIG. 2 illustrates an overhead view of the layout of the modular service station assembly and interacting printer mechanisms in an inkjet printer according to an embodiment of the invention.

FIG. 2 shows an overhead view of the layout of the modular service station assembly and the interacting printer mechanisms as situated within the printer housing 102 of the inkjet printer 100 in accordance with an embodiment. The inkjet printer 100 has two carriage assemblies 201*a*, 201*b*, each adapted to accommodate two print cartridges 202*a*, 202*b*, 202*c*, 202*d*, each print cartridge 202*a*, 202*b*, 202*c*, 202*d* having a print head 203.

The modular service station assembly has two ink spittoons 204*a*, 204*b*. The ink spittoons provide a receptacle or pit for the collection of waste ink. The ink spittoons may comprise a single receptacle servicing all print cartridges, or may comprise separate receptacles for different inks as in the illustrated embodiment.

A wiping station 205 is also provided in the modular service station assembly, comprising two modules 205*a*, 205*b*, each having a wiper 206*a*, 206*b* for cleaning the print heads 203 by wiping residual ink or particulates from their surface.

The modular service station assembly further provides a capping station 207. The capping station 207 has two caps 208*a*, 208*b* for sealing the print heads 203 whilst not in use, thereby preventing any ink within the print heads 203 from drying out and clogging. Capping the print heads 203 while not in use further prevents the print heads 203 from becoming contaminated with various particulates such as paper, dust and fibres.

A print zone 209 is the region of the printer 100 where ink is deposited onto a print medium 210. The dimensions of the print zone 209 are typically marginally less than the measurement across the print medium 210. In accordance with an embodiment, the ink spittoons 204*a*, 204*b*, capping station 207 and wiping stations 205*a*, 205*b* each comprise a discrete module or unit. Each discrete unit is separately disposed to either side of the print zone 209 of the printer 100.

An ink spittoon comprising a single unit may be positioned to one side of the print zone 209. In the illustrated embodiment, an ink spittoons comprising two modules 204*a*, 204*b* being positioned on either side of the print zone 209. Similarly, a wiping station comprising a single unit may be disposed to one side of the print zone 209. Where two wipers 206*a*, 206*b* service a plurality of print heads 203*a*, 203*b*, 203*c*, 203*d*, the wiping stations 205*a*, 205*b* are discretely disposed on either side of the print zone 209.

The ink spittoons 204*a*, 204*b* and the wiping stations 205*a*, 205*b* may be adjacently disposed and may be arranged in alignment with the carriage assemblies 201*a*, 201*b*, either side of the print zone. In accordance with the embodiment shown in FIG. 2, the wiping station has two wipers 206*a*, 206*b* and is configured as two separate modules or wiping stations 205*a*, 205*b* each being associated with an ink spittoon 204*a*, 204*b*. This arrangement provides for the print heads 203 to be serviced one at a time. That is, wiping station 205*a* disposed on the left of the printer housing 102 services a left print head 203*a*, 203*b*, whilst the wiping station 205*b* disposed on the right of the printer housing 102 services a right print head 203*c*, 203*d*. Each wiping station 205*a*, 205*b* is associated with an adjacently positioned ink spittoon 204*a*, 204*b*.

The capping station 207, is positioned within the print zone 209 of the printer 100. The width A of the printer housing 102 is reduced to width B by positioning the capping station 207 within the print zone 209. This provides a substantial space saving of width C. The configuration described overcomes the need to increase the width of the printer housing 102 substantially beyond the dimensions of the print medium 210 in order to accommodate the capping station 207.

Figure 3:
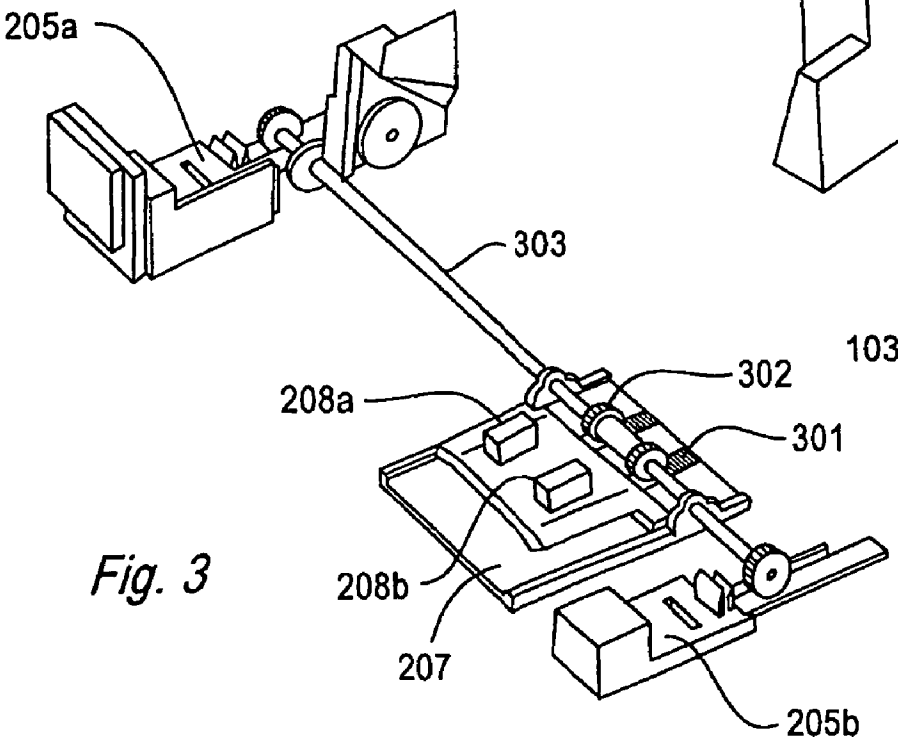
FIG. 3 illustrates a view of the modular service station configuration according to an embodiment of the invention.

FIG. 3 illustrates a view of the modular service station configuration according to an embodiment. A displacement mechanism for causing simultaneous linear displacement of the capping station 207 and the wiping stations 205*a*, 205*b* has a suitable motor which may make use of a rack 301 and pinion 302 gear system to effect a conversion between rotary and linear motion. The motion of the capping station 207 is linked with the motion of the wiping stations 205*a*, 205*b* via a linkage shaft 303, thereby allowing a single motor to simultaneously displace the capping station 207 and the wiping stations 205*a*, 205*b*. The capacity to rely on a single motor to drive the motion of the independently service station assembly modules reduces the demands for space within the printer.

The capping station 207 is designed to be displaced vertically in response to movement of the wiping stations 205*a*, 205*b*. The wiping stations 205*a*, 205*b* are designed to be displaced in the horizontal plane, moving backwards and forwards between the front 103 and rear 104 of the printer housing 102. The simultaneous motion of the capping station 207 and wiping station 205*a*, 205*b* modules is facilitated by the linkage shaft 303.

Clockwise rotation of the linkage shaft 303 causes the wiping stations 205*a*, 205*b* to be displaced towards the rear 104 of the printer housing 102 and the capping station 207 is simultaneously displaced upwards. Similarly, anti-clockwise rotation of the linkage shaft 303 causes the wiping stations 205*a*, 205*b* to be displaced towards the front 103 of the printer housing, whilst the capping station 207 is simultaneously displaced downwards. These simultaneous motions may be facilitated by the operation of the rack 301 and pinion 302 gear system which effects the conversion between rotary and linear motion. The rack 301 and pinion 302 gear system may be integral with the capping station 207 as shown in FIG. 3.

Figure 4:
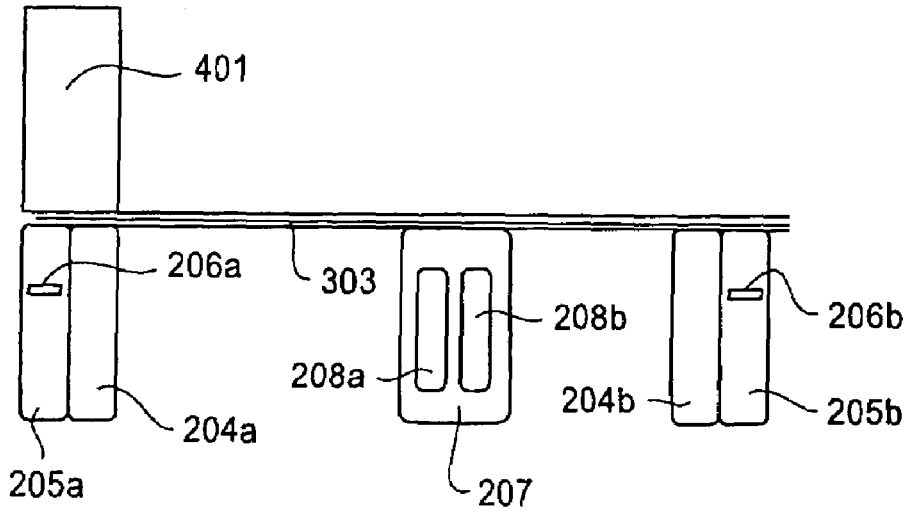
FIG. 4 illustrates an overhead view of the arrangement of the service station and displacement mechanism according to an embodiment of the present invention.

FIG. 4 illustrates an overhead view of the arrangement of the service station and displacement mechanism. The modular service station components are arranged as in FIG. 4 showing the ink spittoons 204*a*, 204*b*, capping station 207 and wiping stations 205*a*, 205*b* configured to optimise the space saving in the width of the printer 100. Also illustrated is the relative position of the displacement mechanism 401 for simultaneously causing linear displacement of the capping station 207 and the wiping station 205*a*, 205*b*.

Connection between discrete units of the modular service station is maintained via the linkage shaft 303, which runs from left to right linking the capping station 207 and the wiping stations 205*a*, 205*b* with the displacement mechanism 401. The displacement mechanism 401 is adapted to simultaneously cause linear displacement of the capping station 207 and the wiping station 205*a*, 205*b*. The ink spittoons 204*a*, 204*b*, which are disposed adjacently to the wiping stations 205*a*, 205*b* at either side of the printer housing 102, are static modules which are not linked to other service station components by the linkage shaft 303. The positioning of the displacement mechanism 401 as illustrated in FIG. 4 optimises the use of space within the printer housing 102.

In an embodiment, there is provided an inkjet printer 100 having a housing 102 with front 103 and rear 104 ends having a print zone 209 and one or more carriage assemblies adapted to accommodate at least one print cartridge 202*a*, 202*b*, 202*c*, 202*d* having a print head 203*a*, 203*b*, 203*c*, 203*d*. The inkjet printer 100 also has a service station assembly to provide for maintenance of the print heads 203*a*, 203*b*, 203*c*, 203*d*. The service station assembly has at least one ink spittoon 204*a*, 204*b*; a wiping station 205*a*, 205*b* including at least one wiper 206*a*, 206*b* for cleaning the print head 203*a*, 203*b*, 203*c*, 203*d* the at least one ink spittoon 204*a*, 204*b* and the wiping station 205*a*, 205*b* being separately disposed to one side of the print zone 209; a capping station 207 disposed within the print zone 207 including at least one cap 208*a*, 208*b* for sealing the print head 203*a*, 203*b*, 203*c*, 203*d*; and a plurality of discrete modules, arranged to minimize the width of the printer housing 102. The ink spittoon 204*a*, 204*b* and wiping station 205*a*, 205*b* may be disposed adjacently and in alignment with the carriage assemblies.

The inkjet printer 100 may further include a displacement mechanism 401 for simultaneously causing linear displacement of the capping station 207 and the wiping station 205*z*, 205*b*; and a linkage shaft 303 interconnecting the capping station 207 and the wiping station 205*a*, 205*b* with the displacement mechanism 401. In one embodiment, the displacement mechanism 401 comprises a rack 301 and pinion 302 gear system.

Clockwise rotation of the linkage shaft 303 may cause the wiping station 205*a*, 205*b* to be displaced towards the rear 104 of the printer housing 102 and the capping station 207 to be simultaneously displaced upwards. Anti-clockwise rotation of the linkage shaft 303 may cause the wiping station 205*a*, 205*b* to be displaced towards the front 103 of the printer housing 102 and the capping station 207 is simultaneously displaced downwards.

While the embodiments of the present invention have been illustrated in detail, it should be apparent that modifications and adaptations to these embodiments may occur to one skilled in the art without departing from the scope of the present invention as set forth in the following claims.

We claim:

1. A modular service station assembly for use with an inkjet printer, the inkjet printer including a housing with front and rear ends having a print zone and one or more carriage assemblies adapted to accommodate at least one print cartridge having a print head, the service station assembly comprising:

at least one ink spittoon;

a wiping station including at least one wiper for cleaning the print head wherein the at least one ink spittoon and the wiping station are separately disposed to one side of the print zone;

a capping station disposed within the print zone including at least one cap for sealing the print head;

a displacement mechanism for simultaneously causing linear displacement of the capping station and the wiping station; and a linkage shaft interconnecting the capping station and the wiping station with the displacement mechanism.

2. A modular service station assembly according to claim 1, wherein the at least one ink spittoon and wiping station are disposed adjacently to one another and in alignment with the one or more carriage assemblies.

3. A modular service station assembly according to claim 1, wherein the displacement mechanism comprises a rack and pinion gear system.

4. A modular service station assembly according to claim 1, wherein clockwise rotation of the linkage shaft causes the wiping station to be displaced towards the rear of the printer housing and the capping station is simultaneously displaced upwards.

5. A modular service station assembly according to claim 1, wherein anti-clockwise rotation of the linkage shaft causes the wiping station to be displaced towards the front of the printer housing and the capping station is simultaneously displaced downwards.

6. An inkjet printer including a housing with front and rear ends having a print zone and one or more carnage assemblies adapted to accommodate at least one print cartridge having a print head and a service station assembly comprising:

at least one ink spittoon;

a wiping station including at least one wiper for cleaning the print head the at least one ink spittoon and the wiping station being separately disposed to one side of the print zone;

a capping station disposed within the print zone including at least one cap for sealing the print head;

a displacement mechanism for simultaneously causing linear displacement of the capping station and the wiping station; and a linkage shaft interconnecting the capping station and the wiping station with the displacement mechanism.

7. An inkjet printer according to claim 6, wherein the at least one ink spittoon and wiping station are disposed adjacently and in alignment with the one or more carriage assemblies.

8. An inkjet printer according to claim 6, wherein the displacement mechanism comprises a rack and pinion gear system.

9. An inkjet printer according to claim 6, wherein clockwise rotation of the linkage shaft causes the wiping station to be displaced towards the rear of the printer housing and the capping station is simultaneously displaced upwards.

10. An inkjet printer according to claim 6, wherein anti-clockwise rotation of the linkage shaft causes the wiping station to be displaced towards the front of the printer housing and the capping station is simultaneously displaced downwards.

* * * * *

UNITED STATES PATENT AND TRADEMARK OFFICE

CERTIFICATE OF CORRECTION

PATENT NO. : 7,029,093 B2
APPLICATION NO. : 10/741131
DATED : April 18, 2006
INVENTOR(S) : Ah Chong Tee et al.

It is certified that error appears in the above-identified patent and that said Letters Patent is hereby corrected as shown below:

Column 6, line 5, “carnage” should read -- carriage --.

Signed and Sealed this

Twenty-second Day of August, 2006

JON W. DUDAS
*Director of the United States Patent and Trademark Office*